US005549061A

United States Patent [19]

Oda et al.

[11] Patent Number: 5,549,061

[45] Date of Patent: Aug. 27, 1996

[54] DRIVE FORCE TRANSMISSION FOR A SHUTTLE SECTION IN A SEWING MACHINE

[75] Inventors: Yo Oda; Tadayoshi Minakawa; Shyoichi Sibuya; Takayuki Shiina, all of Tokyo, Japan

[73] Assignee: Juki Corporation, Tokyo, Japan

[21] Appl. No.: 410,799

[22] Filed: Mar. 28, 1995

[30] Foreign Application Priority Data

Mar. 29, 1994 [JP] Japan ..... 6-059186

[51] Int. Cl.[6] ..... D05B 69/16

[52] U.S. Cl. ..... 112/220

[58] Field of Search ..... 112/163, 166, 112/189, 181, 182, 190, 192, 220, 228, 272

[56] References Cited

U.S. PATENT DOCUMENTS

| | | | |
|---|---|---|---|
| 865,149 | 9/1907 | Ammerman | 112/182 |
| 1,396,040 | 11/1921 | Herr | 112/182 |
| 2,235,467 | 7/1943 | Beyer | 112/192 |
| 4,043,283 | 8/1977 | Jung | 112/163 |
| 4,467,737 | 8/1984 | Breck, Jr. | 112/220 X |

FOREIGN PATENT DOCUMENTS

| | | | |
|---|---|---|---|
| 884450 | 7/1953 | Germany | 112/192 |
| 296837 | 5/1971 | U.S.S.R. | 112/185 |
| 1057589 | 11/1983 | U.S.S.R. | 112/185 |
| 2188951 | 10/1987 | United Kingdom . | |

*Primary Examiner*—C. D. Crowder

*Attorney, Agent, or Firm*—Morgan, Lewis and Bockius LLP

[57] ABSTRACT

A drive force transmission for a shuttle section in a sewing machine in which a rotation of a spindle is transmitted and transformed into a swing motion to an output shaft coupled with the shuttle section, the drive force transmission comprising: a power transmission mechanism coupled with the spindle; a drive force transmission shaft rotating by the rotation of the spindle through the power transmission mechanism; and a force transforming mechanism provided between the drive force transmission shaft and the output shaft, for transforming the rotation from the drive force transmission shaft into the swing motion of the output shaft.

9 Claims, 9 Drawing Sheets

DRIVE FORCE TRANSMISSION FOR A SHUTTLE SECTION IN A SEWING MACHINE

BACKGROUND OF THE INVENTION

1. Field of the Invention

The present invention relates to a drive force transmission which transmits a full rotation and transforms the full rotation into a half turn. More specifically, the invention relates to a drive force transmission in a sewing machine, for transmitting a drive force from a rotary shaft, such as an arm shaft (spindle), which fully turns in synchronism with a motor, to a shuttle section which moves in a swing or in a half turn in alternative directions.

2. Discussion of the Related Art

A conventional sewing machine is provided with a drive force transmission which transmits a drive force from the arm shaft of full turn to a shuttle section to repeat a half turn motion as the result of a swing motion caused by the drive force. A half turn transmission mechanism as shown in FIGS. 9 and 10 has been known as the drive force transmission.

In the example of FIG. 9, reference numeral 81 designates an arm shaft; 82, a coupling rod; 83, a large pendulum; 84, an output shaft (oscillating shaft); and 85, a shuttle section. As shown, a pulley 81*a* and a crank 81*b* are attached to the arm shaft 81. The crank 81*b* is coupled with the upper end of the coupling rod 82. The lower end of the coupling rod 82 is coupled with a lever 83*a* of the large pendulum 83.

A gear 83*b* of the large pendulum 83 is in mesh with a gear 84*a* of the oscillating shaft 84. The shuttle section 85 is mounted on the end of the oscillating shaft 84. The shuttle section 85 includes a shuttle 85*a*, a half-turn hook press 85*b*, and the like. As already known, the shuttle section contains therein a bobbin case, a bobbin, a half-turn hook, and a driver.

In the example of FIG. 10, reference numeral 91 designates an arm shaft; 92, a coupling rod; 93, a large pendulum; 94, an output shaft (oscillating shaft A); 95, a shuttle section; 96, an additional oscillating shaft; 97, an output shaft (oscillating shaft); 98, a shuttle section. The upper end of the coupling rod 92 is coupled with a crank 91*b* of the arm shaft 91. The lower end of the coupling rod 92 is coupled with a lever 93*a* of the large pendulum 93. A gear 94*a* of the oscillating shaft 94 is in mesh with a gear 93*b* of the large pendulum 93. The shuttle section 95 meshes with the end of the oscillating shaft 94.

A gear 96*a* of the additional oscillating shaft 96 meshes with the gear 93*b* of the large pendulum 93. A gear 97*a* of the oscillating shaft 97 is in mesh with a gear 96*b* arranged at the end of the additional oscillating shaft 96. A shuttle section 98 is mounted on the end of the oscillating shaft 97. Accordingly, the shuttle section 98 is disposed in opposition to the shuttle section 95. Thus, two needles are used in the sewing machine described above.

The conventional drive force transmission for the shuttle section suffers from the following problems.

(1) In the example of FIG. 9, in a case where the oscillating shaft 84 used is long, the shaft is deflected, and the half-turn thereof causes a deflection or a twist between the gear 84*a* and the shuttle section 85. The deflection and twist can be deterred by increasing the thickness of the oscillating shaft 84. In this case, the weight of the drive force transmission including such a thick oscillating shaft 84 is correspondingly increased. Further, a large inertia is generated in the oscillating shaft when it repeats a half turn motion, thereby making gear sound noisy and vibration unnegligent.

As in the example of FIG. 10, when the gear 93*b* of the large pendulum 93 is combined with a long gear like the gear 96*a* of the additional oscillating shaft 96, it may be slid in the axial direction. When the long gear is used, the weight thereof is increased and the inertia caused by the half turn is increased.

In an example of FIG. 11, a connection member 101, such as a sleeve 99 or a coupling 100 as shown in FIG. 12(*a*) or 12(*b*), is used. It may be slid in the axial direction. This case also suffers from the increase of the weight and inertia.

(2) In a case as shown in FIG. 9 where a drive force is transmitted through a following route: the arm shaft (full turn)→large pendulum (swing)→oscillating shaft (half turn), and the shaft for the half turn is used as the output shaft, the load (inertia, etc.) of the gear, gear sound, and twist of the oscillating shaft are small unless the output shaft is long. In a case as shown in FIG. 10 where a drive force is transmitted through a following route: the arm shaft (full turn)→large pendulum (swing)→additional oscillating shaft (half turn)→gear 96*b* (half turn)→gear 97*a* (half turn), that is, the half turn is transmitted from the shaft of half turn (additional oscillating shaft) to another shaft 97 (oscillating shaft), a mass of the half turn transmission mechanism is increased, and the inertia by the half turn becomes large. Further, since the long shaft, or the additional oscillating shaft, is used, it affects an influence on the twist of the additional oscillating shaft. As a result, the gear sound and vibration are increased.

SUMMARY OF THE INVENTION

Accordingly, an object of the present invention is to provide a drive force transmission for a shuttle section in a sewing machine in which a rotation force may be taken out of any position on a rotary shaft, such as an arm shaft, a drive force transmission shaft to which the rotation is transmitted and an output shaft may be moved in the axial direction, whereby a load of the gear caused by an inertia generated by a swing motion, such as a half turn motion, is reversed in the direction, twist of the drive force transmission shaft, noisy sound of the gear, and vibration are lessened.

To achieve the above object, one aspect of the present invention provides a drive force transmission for a shuttle section in a sewing machine in which a rotation of a spindle is transmitted and transformed into a swing motion to an output shaft coupled with the shuttle section, the drive force transmission comprising: a power transmission mechanism coupled with the spindle; a drive force transmission shaft rotating by the rotation of the spindle through the power transmission mechanism; and a force transforming mechanism provided between the drive force transmission shaft and the output shaft, for transforming the rotation from the drive force transmission shaft into the swing motion of the output shaft.

A second aspect of the present invention provides the drive force transmission according to the first aspect, wherein the force transforming means comprises a crank mechanism including: a first eccentric shaft arranged on the drive force transmission shaft; a swing shaft coupled with the output shaft; a second eccentric shaft arranged on the swing shaft; and a coupling member for coupling the first and second eccentric shafts.

A third aspect of the present invention provides the drive force transmission described above, wherein the power transmission means is a timing belt mechanism or a shaft drive mechanism.

The drive force transmission for a shuttle section in a sewing machine according to the present invention includes a drive force transmission shaft to which a rotation is transmitted from an arm shaft through a power transmission means and the force transforming means between the drive force transmission shaft and an output shaft with the shuttle section. With this construction, the full turn is transmitted up to the drive force transmission shaft near the output shaft, thereby reducing a mass of the half turn transmission mechanism necessary for driving the shuttle section. This results in lessening a load of the gear caused by an inertia thereof generated by the half turn, a twist of the drive force transmission shaft, noise by a tooth sound, and vibration.

A rotation is taken out of the arm shaft to the drive force transmission shaft through the power transmission means. With this construction, it can be taken out of any position on the arm shaft. No provision of a crank on the arm shaft is required for obtaining a half turn. Therefore, the drive force transmission shaft which receives the full turn may axially be moved relative to the output shaft of half turn.

The transforming means is a crank mechanism including an eccentric shaft arranged on the drive force transmission shaft, an eccentric shaft arranged on a swing shaft in a state that it is coupled with the output shaft with gears intervening therebetween, and a coupling member for coupling these eccentric shafts. With this construction, a full turn of the drive force transmission shaft is transformed into a half turn of the output shaft.

The power transmission means may be a timing belt mechanism or a shaft drive mechanism. With this construction, a full turn of the rotary shaft may be transmitted in the form of a full turn of the drive force transmission shaft. Particularly, in the case of the timing belt, it may easily be moved in the axial direction.

DETAILED DESCRIPTION OF THE PREFERRED EMBODIMENTS

The preferred embodiment of a drive force transmission for a shuttle section in a sewing machine according to the present invention will described with reference to FIGS. 1 through 7.

Figure 1:
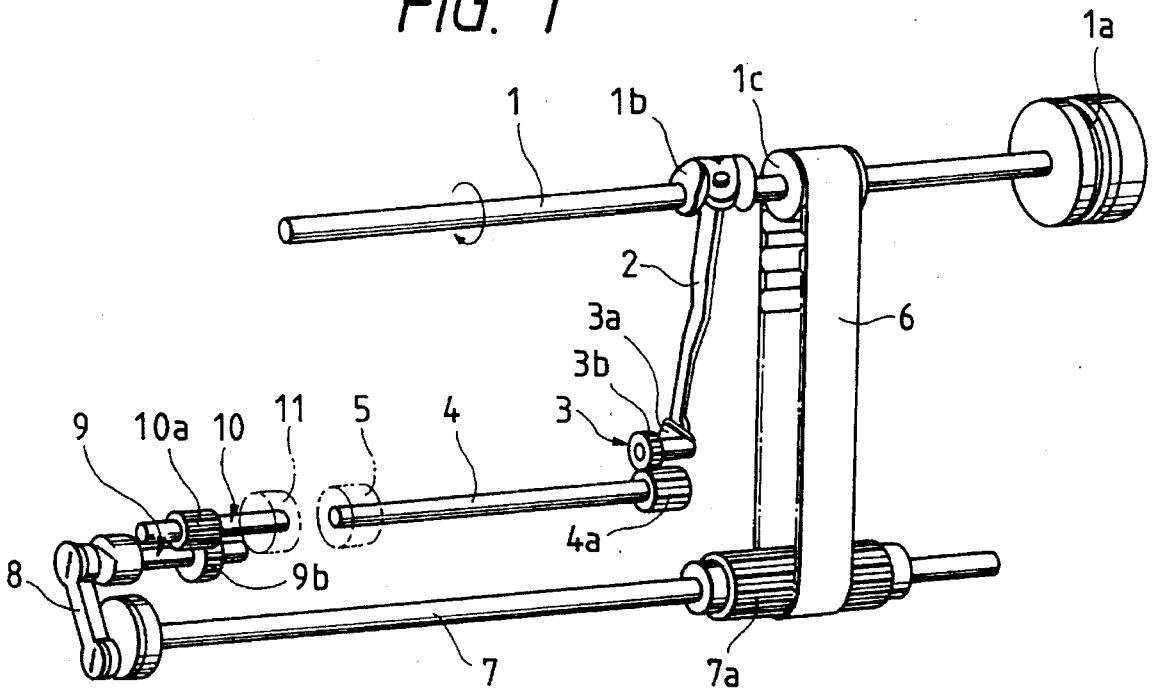
FIG. 1 is perspective view showing a drive force transmission for a shuttle section in a sewing machine according to an embodiment of the present invention.

FIG. 1 shows a view showing a drive force transmission for a shuttle section in a sewing machine into which the present invention is incorporated. In the figure, reference numeral 1 designates an arm shaft (rotary shaft); 2, a coupling rod; 3, a large pendulum; 4, an output shaft (oscillating shaft); 5, a shuttle section; 6, a timing belt; 7, a drive force transmission shaft; 8, a coupling member (coupling rod); 9, a swing shaft; 10, an output shaft (oscillating shaft); 11, a shuttle section.

In the first embodiment, as shown, a pulley 1*a* which receives a drive force through a belt, not shown, is fastened to the right end (as viewed in the drawing) of the arm shaft as a rotary shaft. The arm shaft 1 further includes a crank section 1*b*. The upper end of the coupling rod 2 is coupled with the crank section 1*b*. The lower end of the coupling rod 2 is coupled with an eccentric position 3*a* of the large pendulum 3. A gear 4*a* fastened to the right end of the oscillating shaft 4 as the output shaft is in mesh with a gear 3*b* of the large pendulum 3. A shuttle section 5 is fastened to the left end of the oscillating shaft 4.

In FIG. 1, a toothed pulley 1*c* is arranged between the pulley 1*a* of the arm shaft 1 and the crank section 1*b*. A timing belt 6 is put on the toothed pulley 1*c*. The timing belt 6 also is put on a toothed pulley 7*a* arranged at the right end part of the drive force transmission shaft 7, located under the oscillating shaft 4. A timing belt mechanism serving as a power transmission means for transmitting a full turn from the arm shaft 1 to the drive force transmission shaft 7 is thus constructed.

Figure 2:
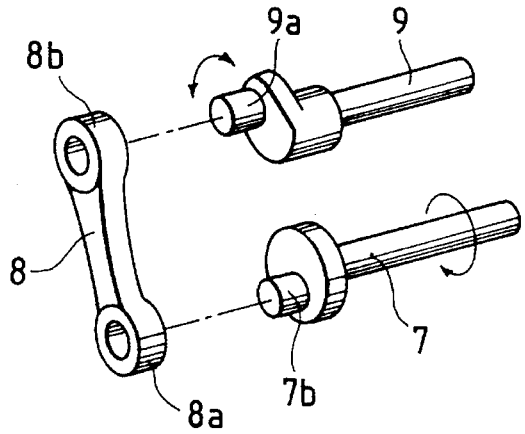
FIG. 2 is an exploded, perspective view showing the details of a crank mechanism in the drive force transmission of FIG. 1 in an enlarged fashion.
Figure 3A:
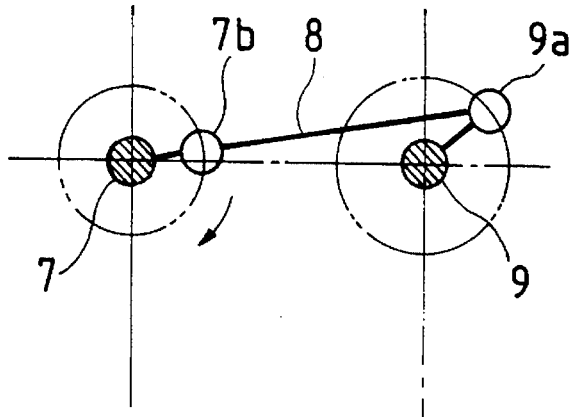
FIGS. 3(*a*) to 3(*d*) are sequential illustrations of a circular motion of the crank mechanism.
Figure 3B:
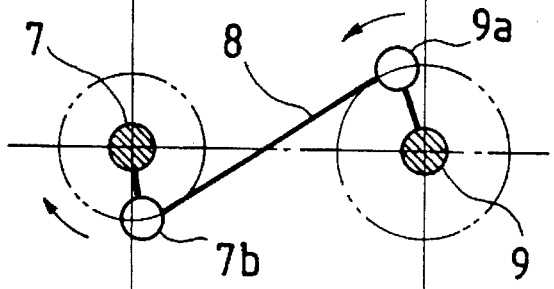
Figure 3C:
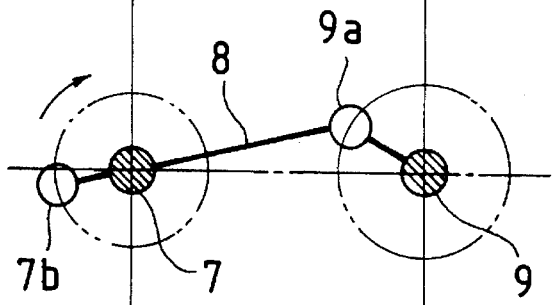
Figure 3D:
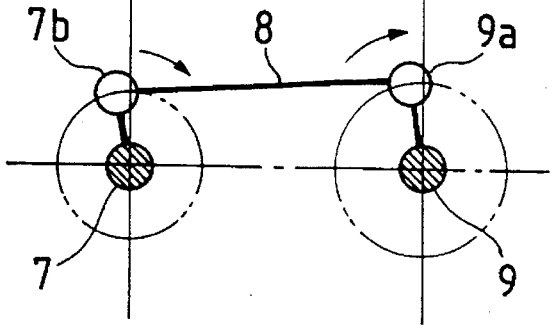

As shown in FIG. 2, an eccentric shaft 7*b* is arranged at the left end of the drive force transmission shaft 7 while the shaft center of the eccentric shaft 7*b* is placed off the axis of the drive force transmission shaft 7. A first end 8*a* of the coupling rod 8 as a coupling member is applied to the eccentric shaft 7*b*. Another eccentric shaft 9*a* is arranged at the left end of the swing shaft 9, located above the eccentric shaft 7*b*, while the eccentric shaft 9*a* is placed off the axis of the axis of the swing shaft. A second end 8*b* of the coupling rod 8 is rotatably coupled with the eccentric shaft 9*a*.

As shown in FIG. 3, the offset quantity of the eccentric shaft 7*b* from the drive force transmission shaft 7 is smaller than that of the eccentric shaft 9*a* from the swing shaft 9. A crank mechanism serving as a force transforming means for transforming a full turn motion of the drive force transmission shaft 7 into a swing motion of the swing shaft 9 is thus constructed.

A gear 9*b* arranged at the right end of the swing shaft 9 is in mesh with a gear 10*a* arranged at to the left end of the oscillating shaft 10 as the output shaft, disposed above the gear 9*b*. A shuttle section 11 is arranged at the right end of the oscillating shaft 10. The shuttle section 11 is disposed in opposition to the shuttle section 5. Accordingly, two needles are used in the sewing machine. The gear 9*b* and the gear 10*a* are set in association with an rotation angle of the oscillating shaft 10.

In the thus constructed drive force transmission for transmitting a half turn motion to the shuttle section of a sewing machine, a drive force of a motor, not shown, is transmitted to the pulley 1*a* through the belt, so that the arm shaft 1 is fully turned and a needle, not shown, is driven to move. At the same time, the full turn motion of the arm shaft 1 is transformed into a swing motion of the large pendulum 3, through the crank section 1*b* and the coupling rod 2. The swing motion is transmitted from the large pendulum 3 to the gear 3*b* where it is transformed into a half turn motion. The half turn motion is transmitted through the gear 4*a* to the oscillating shaft 4 with the shuttle section 5.

The full turn motion is transmitted from the toothed pulley 1*c* to the drive force transmission shaft 7, through the timing belt 6 and the toothed pulley 7*a*. The full turn motion of the drive force transmission shaft 7 is transmitted from the eccentric shaft 7*b* to the swing shaft 9 by way of a route of the coupling rod 8 and the eccentric shaft 9*a*. By the swing shaft 9, the full turn motion is transformed into a swing motion. The swing motion is transmitted through the gears 9*b* and 10*a* to the oscillating shaft 10 and the shuttle section 11, which in turn are turned in a half turn motion.

As already described, the offset quantity of the eccentric shaft 7*b* from the drive force transmission shaft 7 is smaller than that of the eccentric shaft 9*a* from the swing shaft 9. Accordingly, as sequentially shown in FIGS. 3(*a*), 3(*b*) and 3(*c*), a rotation of the eccentric shaft 7*b* having the small offset quantity from the drive force transmission shaft 7 is transformed into a swing motion of the eccentric shaft 9*a* having the large offset quantity. In this way, the full turn motion of the drive force transmission shaft 7 is transformed into the swing motion of the swing shaft 9.

The thus transformed swing motion of the swing shaft 9 is transmitted as a half turn motion to the oscillating shaft 10 with the shuttle section 11. The half turn motion of the oscillating shaft 10 with the shuttle section 11 is in synchronism with the half turn motion of the oscillating shaft 4 with the shuttle section 5.

The half-turn transmission system for the oscillating shaft 10 with the shuttle section 11 has the following useful effects.

(1) After a rotation is taken out of the arm shaft 1 of full turn into the drive force transmission shaft 7 by the timing belt 6, it is transformed into the half turn. Therefore, a rotation necessary for the half turn of the oscillating shaft 10 with the shuttle section 11 can be taken out of any position on the arm shaft 1.

(2) There is no need of providing on the arm shaft 1 any crank shaft other than the crank section 1*b* for taking out for the oscillating shaft 4 with the shuttle section 5. The oscillating shaft 10 of half turn may be shifted in the axial direction by axially sliding the drive force transmission shaft 7, which receives the full turn through the timing belt 6.

(3) By transmitting a drive force in the form of full turn up to the drive force transmission shaft 7 located near the oscillating shaft 10, a mass of the half turn transmission mechanism necessary for driving the shuttle section 11 is reduced. Because of this, a load of the gears (the swing shaft 9 and the gear 10*a*), caused by an inertia generated when the half turn is reversed in the direction, a twist of the drive force transmission shaft 7, noise and vibration by the gear load are reduced.

Figure 4:
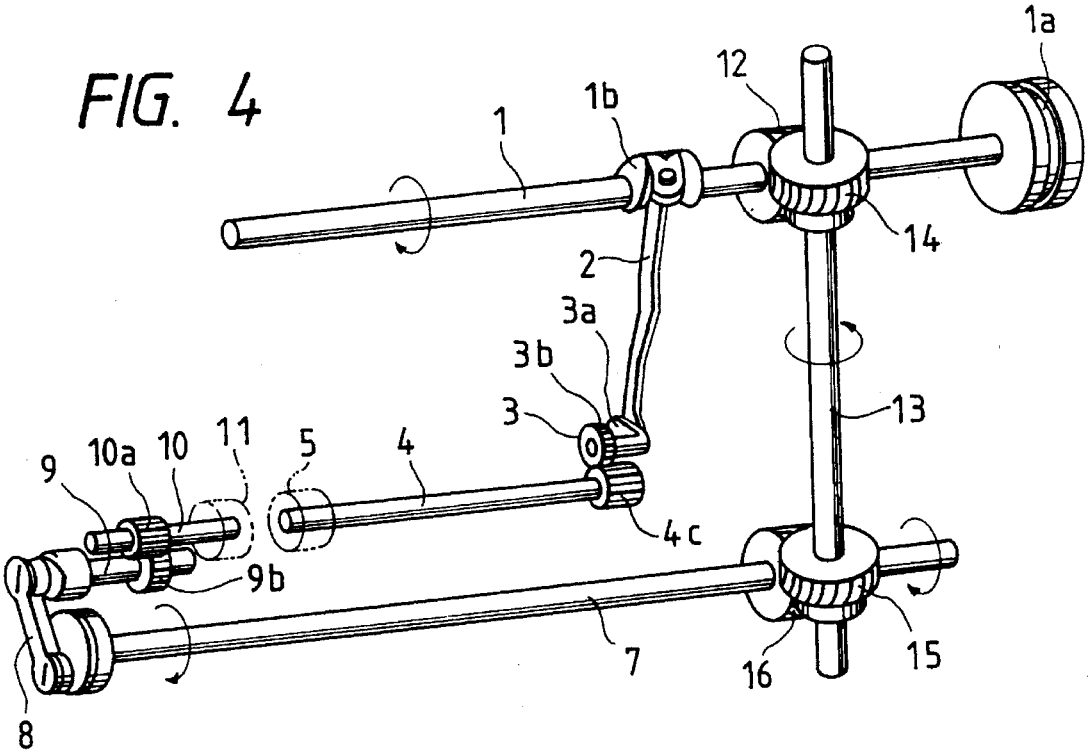
FIG. 4 is a perspective view showing a drive force transmission for a shuttle section in a sewing machine according to a second embodiment of the present invention.

A second embodiment of the present invention will be described with reference to FIG. 4. The second embodiment is different from the first embodiment only in that a shaft drive mechanism is used instead of the belt drive mechanism for transmitting the full turn from the arm shaft 1 to the drive force transmission shaft 7. Hence, only the difference will be described while using same reference numerals in the first embodiment for corresponding portions.

In the second embodiment, as shown, a gear 12 is arranged between the pulley 1*a* and the crank section 1*b*. The gear 12 is in mesh with a gear 14 arranged at the upper end of a vertical shaft 13, in a direction orthogonal to the axial lines each other. The vertical shaft 13 is provided with a gear 15 arranged at the lower end thereof. The gear 15 is in mesh with a gear 16 arranged at the right end of the drive force transmission shaft 7, in the direction orthogonal to the axial lines each other. The drive shaft mechanism serving as a power transmission means using the vertical shaft 13, which is for transmitting a full turn from the arm shaft 1 to the drive force transmission shaft 7 is thus constructed.

The full turn motion of the arm shaft 1 is transmitted through the gear 12 and the gear 14 to the vertical shaft 13, and then from the vertical shaft 13 through the gear 15 and the gear 16 to the drive force transmission shaft 7. The full turn motion of the drive force transmission shaft 7, as in the first embodiment, is transmitted from the eccentric shaft 7*b* through the coupling rod 8 and the eccentric shaft 9*a* to the swing shaft 9. In this way, the full turn motion is transformed into a half turn motion of the swing shaft 9. The half turn motion of the swing shaft 9 is transmitted through the gear 9*b* and the gear 10*a* to the oscillating shaft 10 with the shuttle section 11.

Figure 12A:
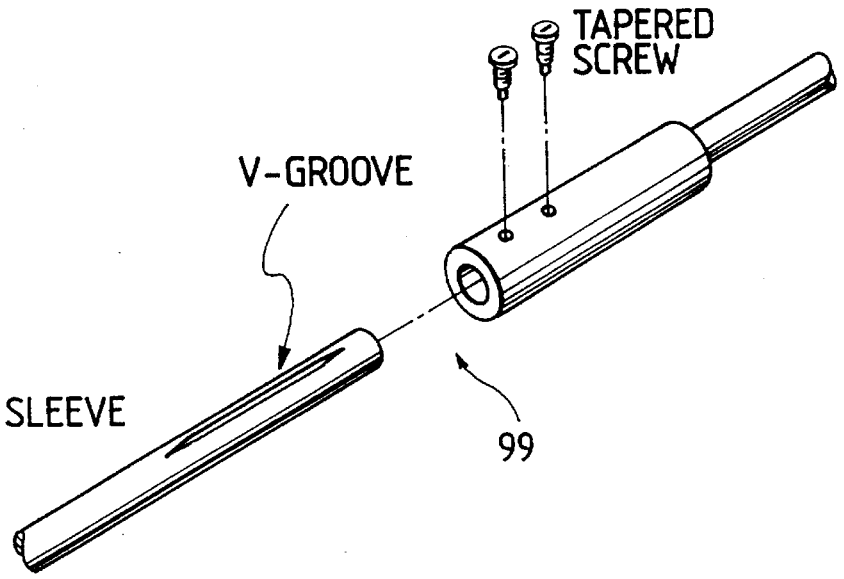
FIGS. 12(*a*) and 12(*b*) perspectively illustrate connection members, which may be used for the half turn mechanism of FIG. 11.
Figure 12B:
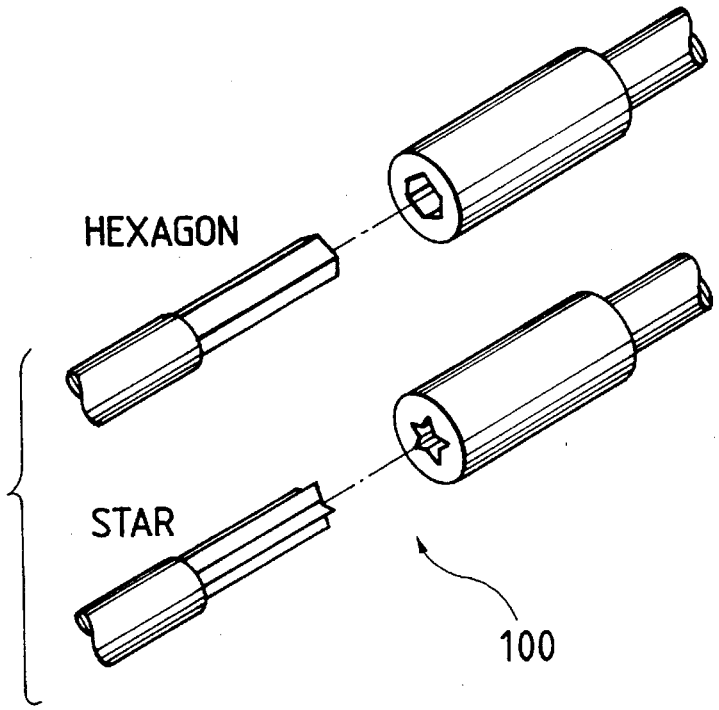

The half turn transmission system for transmitting a half turn motion to the oscillating shaft 10 according to the second embodiment has the useful effects (1) and (3) of the first embodiment. In connection with the effect (2) of the first embodiment, the second embodiment may have the effect comparable with that of the first embodiment by using the sleeve or the coupling shown in FIGS. 12(*a*) and 12(*b*) already referred to.

In the first and second embodiments, the present invention is incorporated into the sewing machine of the type in which two needles are used. An application of the present invention to a sewing machine using one needle will be described.

Figure 5:
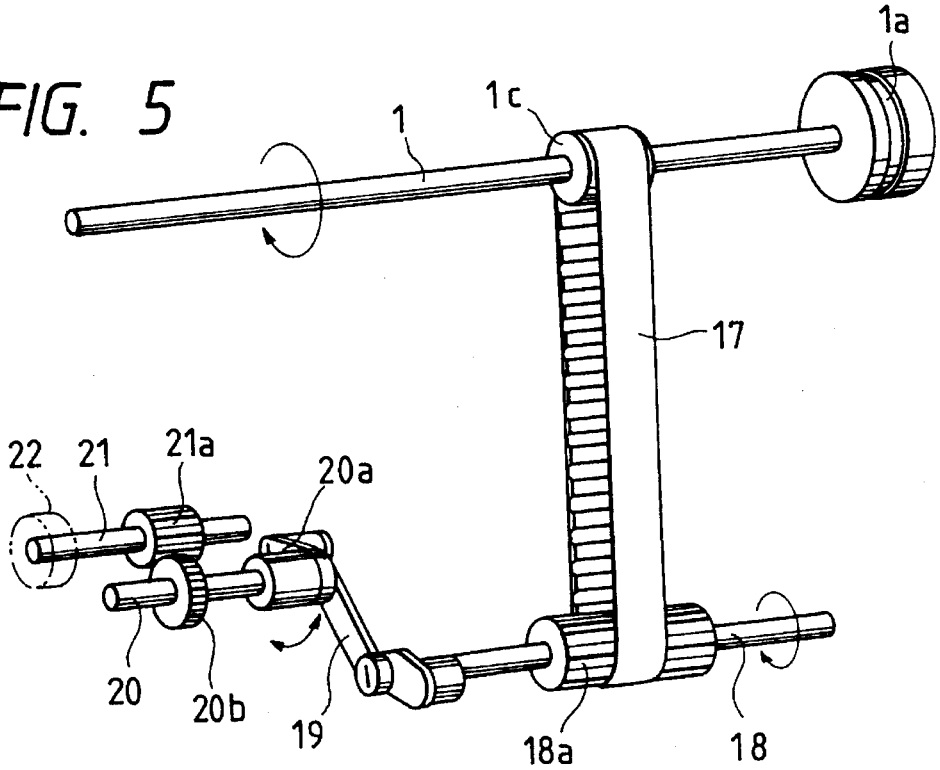
FIG. 5 is a perspective view showing a drive force transmission for a shuttle section in a sewing machine according to a third embodiment of the present invention.

A third embodiment of the present invention will be described with reference to FIG. 5.

In the third embodiment, the toothed pulley 1*c* is located closer to the pulley 1*a* of the arm shaft 1. A timing belt 17 is put on the toothed pulley 1*c* in a meshing fashion. The timing belt 17 is also put on a toothed pulley 18*a*, which is located at a mid part of a drive force transmission shaft 18 located under the arm shaft. A timing belt mechanism serving as a power transmission means for transmitting a full turn motion from the arm shaft 1 to the drive force transmission shaft 18 is thus constructed.

An eccentric shaft (see FIG. 2) of which the center is placed off the drive force transmission shaft 18 is arranged at the left end of the drive force transmission shaft 18. The eccentric shaft is rotatably coupled with a first end of a coupling rod 19. Another eccentric shaft (see FIG. 2) of which the center is placed off a swing shaft 20, located above the former eccentric shaft, is also arranged at the left end of the swing shaft 20. The eccentric shaft is rotatably coupled with a second end of the coupling rod 19. A force transforming means consisting of a crank mechanism for transforming a full turn motion of the drive force transmission shaft 18 into a swing motion of half turn of the swing shaft 20 is thus constructed.

A gear 21*a* arranged at the right end part of the oscillating shaft 21, located above a gear 20*b* arranged at the left end of the swing shaft 20, is in mesh with gear 20*b*. A shuttle section 22 is mounted on the left end of the oscillating shaft 21. An eccentric part 20*a* arranged at the right end of the swing shaft 20 determines its eccentric direction in association with the rotating direction of the oscillating shaft 21.

In a drive force transmission for a shuttle section in a sewing machine thus constructed, a full turn motion of the arm shaft 1 is transmitted from the toothed pulley 1*c* through the timing belt 17 and the toothed pulley 18*a* to the drive force transmission shaft 18. A full turn motion of the drive force transmission shaft 18 is transmitted from the eccentric shaft thereof through the coupling rod 19 and the eccentric shaft to the swing shaft 20. Thus, the full turn motion is transformed into the swing motion of the swing shaft 20. The swing motion of the swing shaft 9 is transformed, through a gear 20*b* and a gear 21*a*, into a half turn motion which in turn is transmitted to an oscillating shaft 21 with a shuttle section 22.

The half turn transmission system for transmitting a half turn motion to the oscillating shaft 21 according to the third embodiment has the useful effects comparable with those of the first embodiment.

Figure 6:
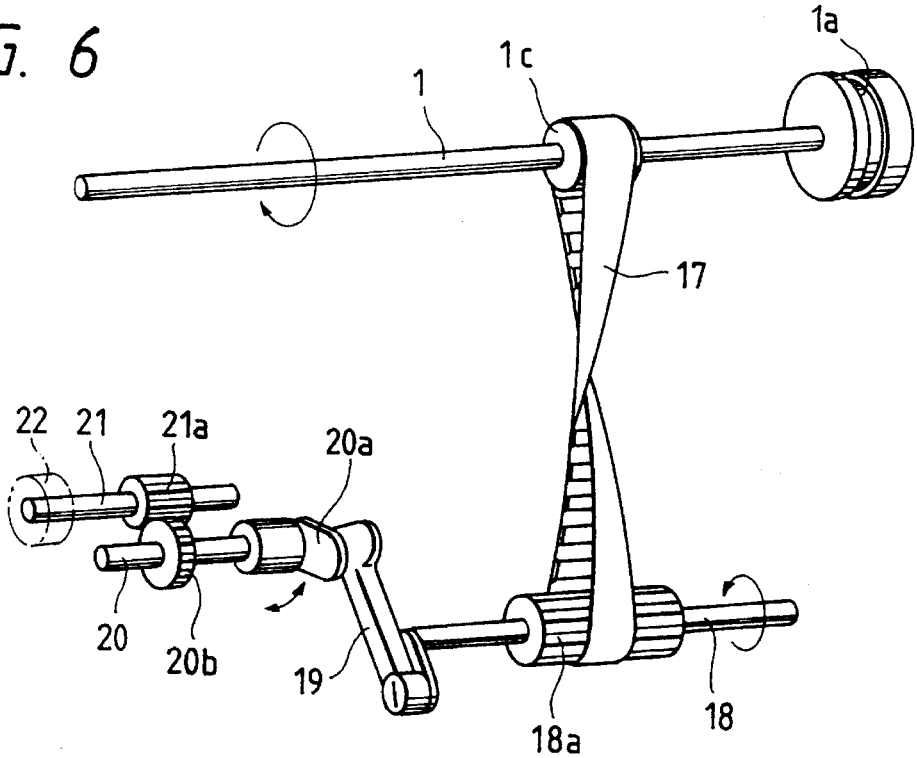
FIG. 6 is a perspective view showing a drive force transmission for a shuttle section in a sewing machine according to a fourth embodiment of the present invention.

A fourth embodiment of the present invention will be described with reference to FIG. 6.

In the fourth embodiment, as shown, the toothed pulley 1*c* is located closer to the pulley 1*a* of the arm shaft 1. A timing belt 17 is put on the toothed pulley 1*c* in a meshing fashion. The timing belt 17 is twisted and put on a toothed pulley 18*a*, which is located at a mid part of a drive force transmission shaft 18 located under the arm shaft. A timing belt mechanism serving as a power transmission means for transmitting a full turn motion from the arm shaft 1 to the drive force transmission shaft 18 is thus constructed.

An eccentric shaft (see FIG. 2) of which the center is placed off the drive force transmission shaft 18 is arranged at the left end of the drive force transmission shaft 18. The eccentric shaft is rotatably coupled with a first end of a coupling rod 19. Another eccentric shaft (see FIG. 2) of which the center is placed off a swing shaft 20, located above the former eccentric shaft, is also arranged at the left end of the swing shaft 20. The eccentric shaft is rotatably coupled with a second end of the coupling rod 19. A crank mechanism serving as a force transforming means for transforming a full turn motion of the drive force transmission shaft 18 into a swing motion of half turn of the swing shaft 20 is thus constructed.

A gear 21*a* arranged at the right end part of the oscillating shaft 21, located above a gear 20*b* arranged at the left end of the swing shaft 20, is in mesh with gear 20*b*. A shuttle section 22 is mounted on the left end of the oscillating shaft 21. The timing belt 17 is twisted for harmony of the rotating direction of the oscillating shaft 21. A slide plate, not shown, is inserted between a place where one side of the timing belt 17 crosses the other side thereof.

In a drive force transmission for a shuttle section in a sewing machine thus constructed, a full turn motion of the arm shaft 1 is transmitted from the toothed pulley 1*c* through the timing belt 17 and the toothed pulley 18*a* to the drive force transmission shaft 18. A full turn motion of the drive force transmission shaft 18 is transmitted from the eccentric shaft thereof through the coupling rod 19 and the eccentric shaft to the swing shaft 20. Thus, the full turn motion is transformed into the swing motion of the swing shaft 20. The swing motion of the swing shaft 9 is transformed, through a gear 20*b* and a gear 21*a*, into a half turn motion which in turn is transmitted to an oscillating shaft 21 with a shuttle section 22.

The half turn transmission system for transmitting a half turn motion to the oscillating shaft 21 according to the fourth embodiment has the useful effects comparable with those of the first embodiment.

Figure 7:
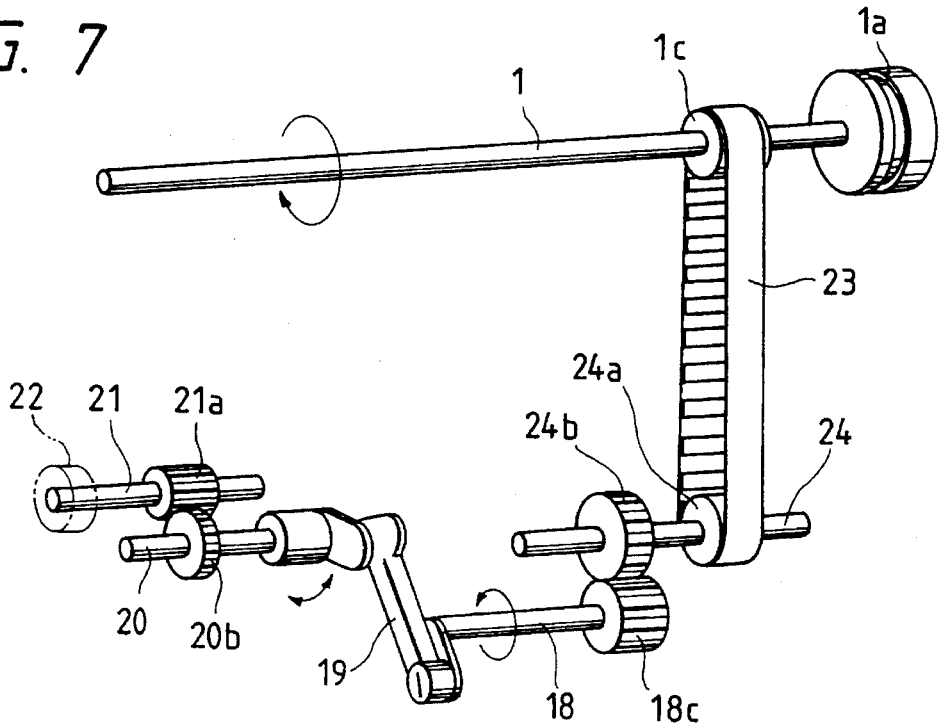
FIG. 7 is a perspective view showing a drive force transmission for a shuttle section in a sewing machine according to a fifth embodiment of the present invention.

A fifth embodiment of the present invention will be described with reference to FIG. 7. The fifth embodiment is different from the fourth embodiment only in that for the transmission means for transmitting a full turn from the arm shaft 1 to the drive force transmission shaft 18, the timing belt is not twisted and a drive force transmission shaft is additionally used. Hence, only the difference will be described while using same reference numerals in the fourth embodiment for corresponding portions.

In the fifth embodiment, as shown, a timing belt 23 is put on the toothed pulley 1*c* of the arm shaft 1 in a meshing fashion. An additional drive force transmission shaft 24 is disposed above the drive force transmission shaft 18. A toothed pulley 24*a* is arranged at the right end of the drive force transmission shaft 24. The timing belt 23 is also put on the toothed pulley 24*a* in a meshing fashion, while not being twisted.

A gear 24*b* mounted at the left end of the drive force transmission shaft 24 is in mesh with a gear 18*c* mounted on the mid part of the drive force transmission shaft 18. A timing belt/gear mechanism serving as a power transmission means for transmitting a full turn motion from the arm shaft 1 to the drive force transmission shaft 18 is thus constructed.

A full turn motion of the arm shaft 1 is transmitted from the toothed pulley 1*c* through the timing belt 23 and the toothed pulley 24*a* to the drive force transmission shaft 24, and further transmitted from the drive force transmission shaft 24 through the gear 24*b* and the gear 18*c* to the drive force transmission shaft 18. The full turn motion of the drive force transmission shaft 18, as in the fourth embodiment, is transmitted from the eccentric shaft through the coupling rod 19 and the eccentric shaft to the swing shaft 20. By the swing shaft 20, the full turn motion is transformed into a swing motion. The swing motion is transformed into a half turn motion through the gear 20*b* and the gear 21*a*. The half turn motion is transmitted to the oscillating shaft 21 with the shuttle section 22.

The half turn transmission system for transmitting a half turn motion to the oscillating shaft 21 according to the fifth embodiment has the useful effects comparable with those of the second embodiment.

Figure 8:
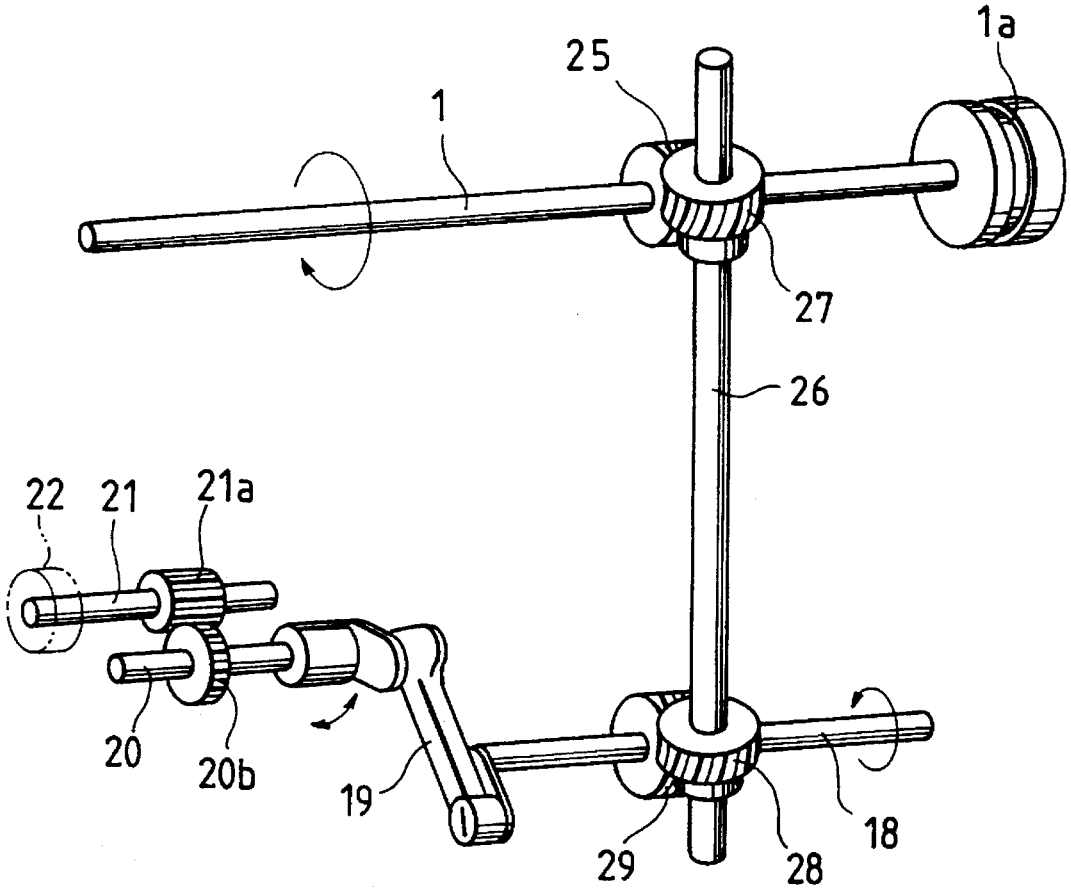
FIG. 8 is a perspective view showing a drive force transmission for a shuttle section in a sewing machine according to a sixth embodiment of the present invention.
Figure 9:
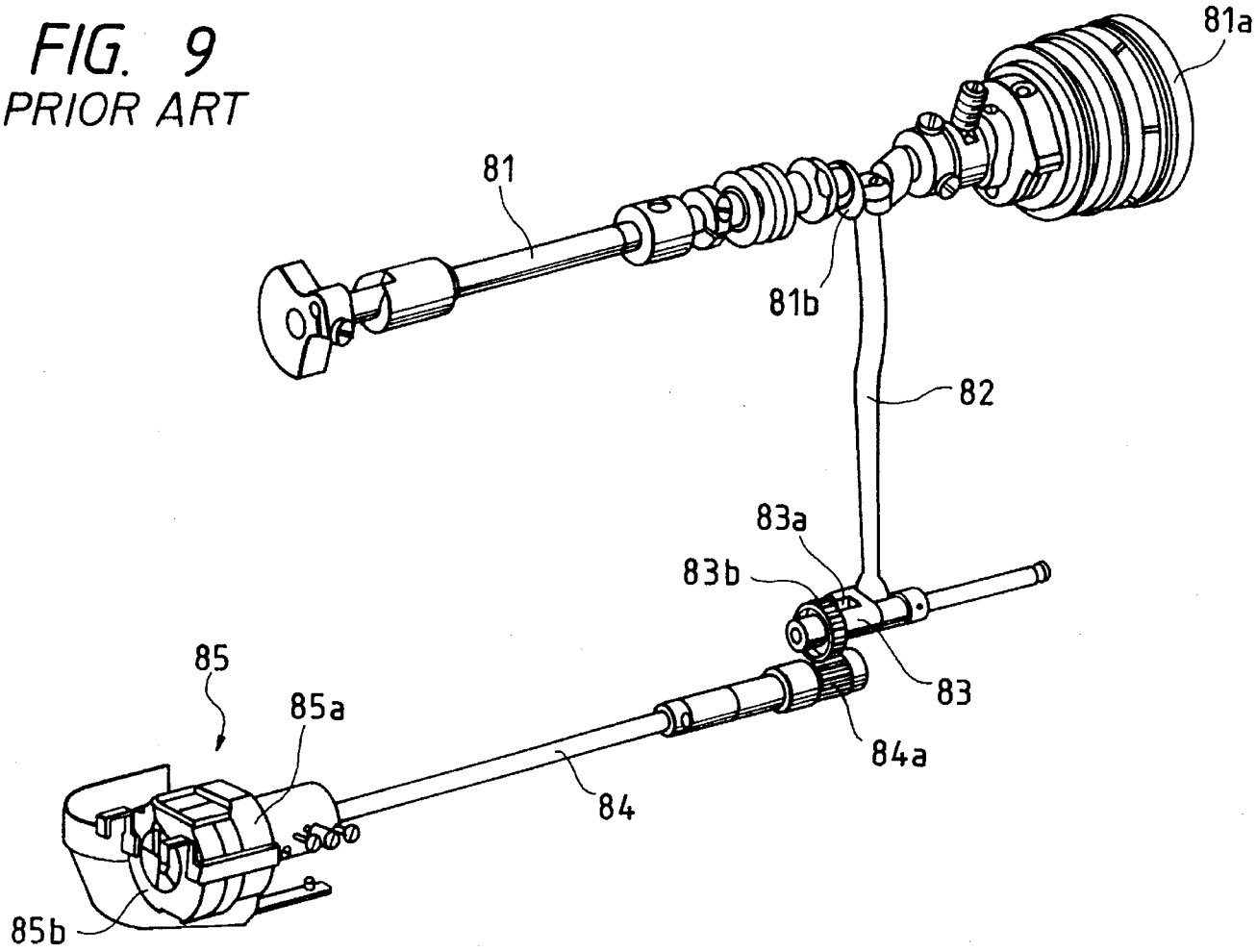
FIG. 9 PRIOR ART
FIG. 9 is a perspective view showing a conventional half turn mechanism.
Figure 10:
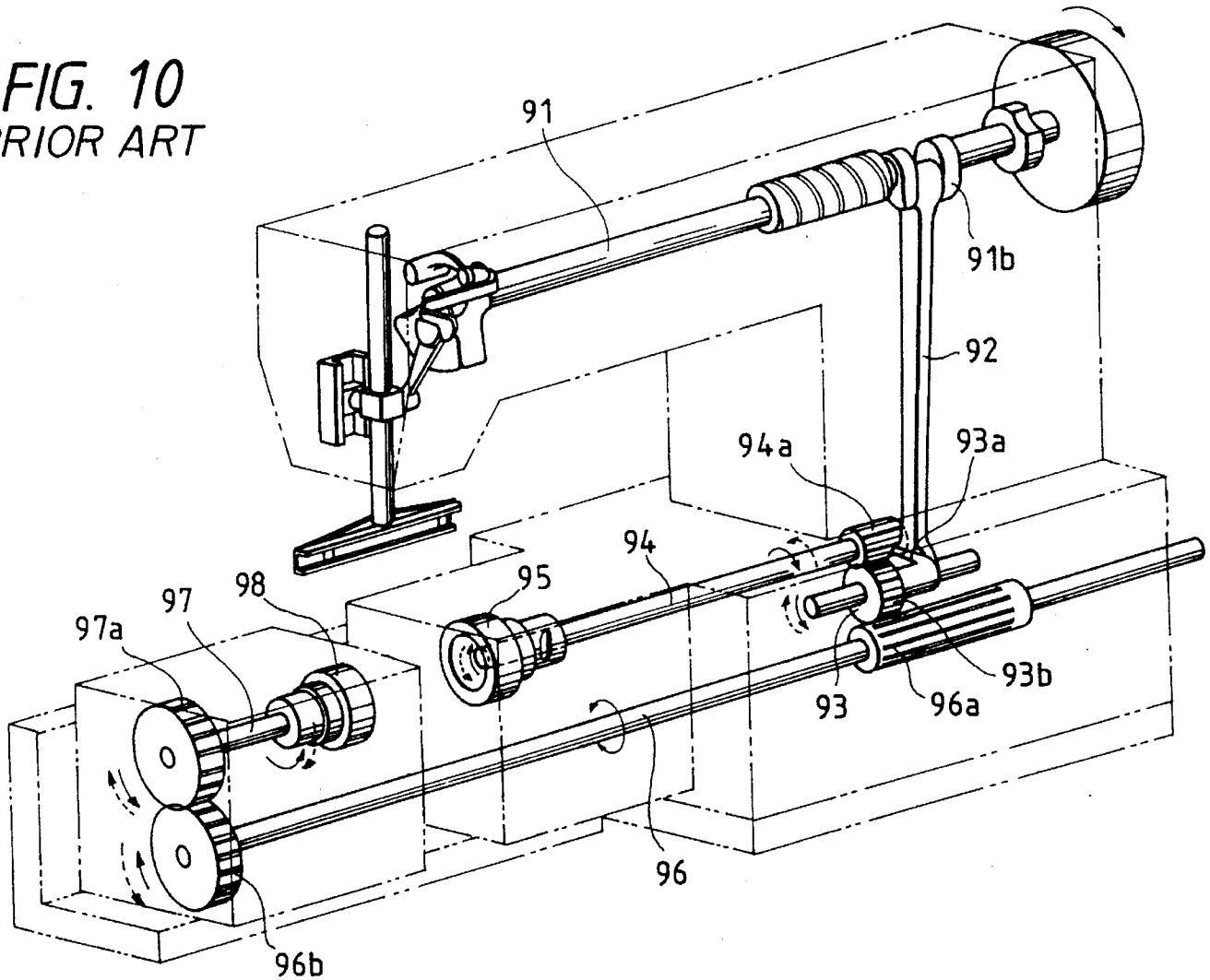
FIG. 10 PRIOR ART
FIG. 10 is a perspective view showing another conventional half turn mechanism.
Figure 11:
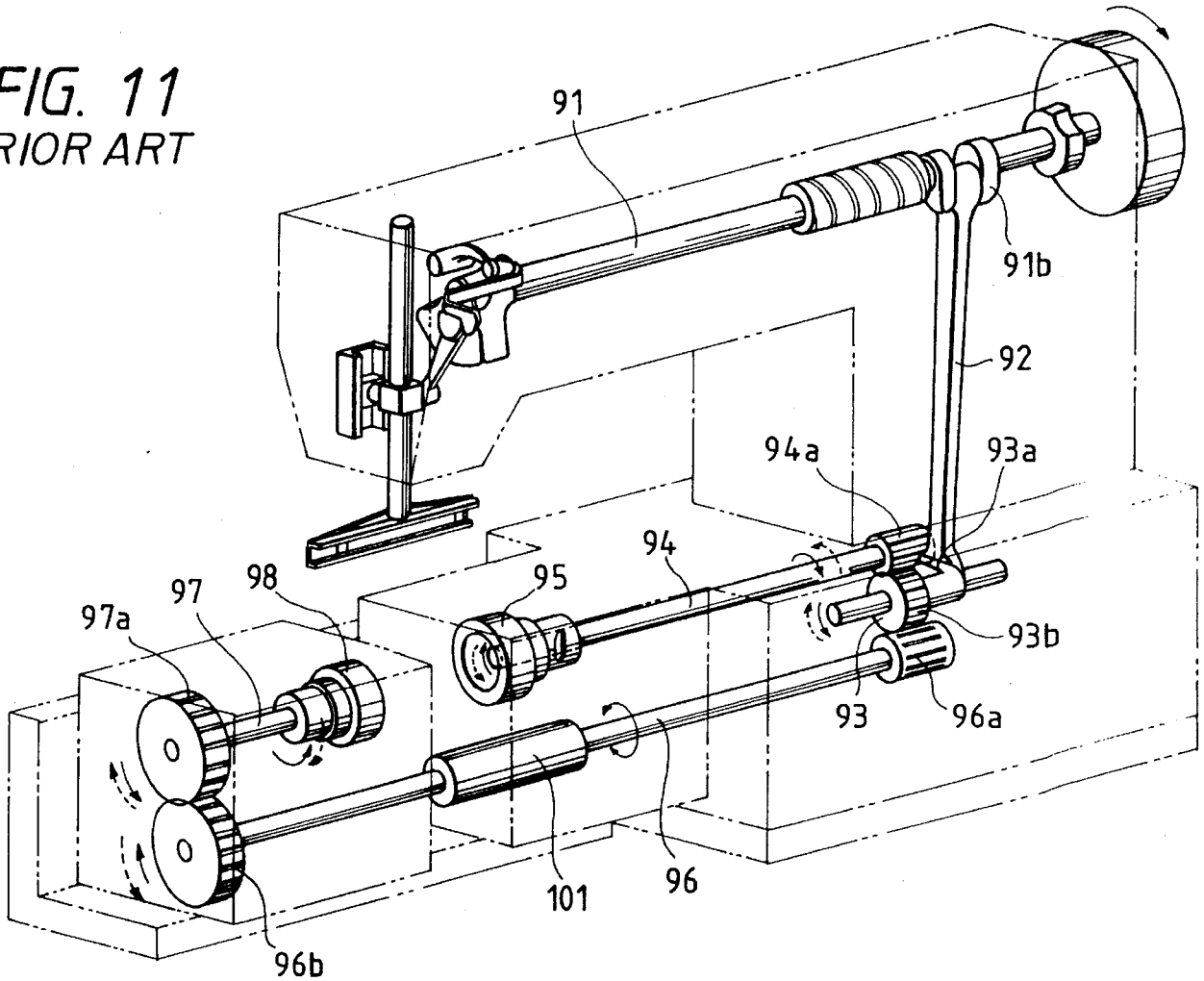
FIG. 11 PRIOR ART
FIG. 11 is a perspective view showing yet another conventional half turn mechanism.

A sixth embodiment of the present invention will be described with reference to FIG. 8. The sixth embodiment is different from the fourth embodiment only in that a shaft drive mechanism is used in place of the timing belt mechanism for transmitting a full turn motion from the arm shaft 1 to the drive force transmission shaft 18. Hence, only the difference will be described while using same reference numerals in the fourth embodiment for corresponding portions.

In the sixth embodiment, as shown, a gear 25 is located closer to the pulley 1*a* of the arm shaft 1. A gear 27 mounted on the upper part of a vertical shaft 26 is in mesh with the gear 25 in the direction orthogonal to the axial lines each other. The vertical shaft 26 is further provided with a gear 28 mounted on the lower part thereof. The gear 28 is in mesh with a gear 29, which is mounted on the mid part of the drive force transmission shaft 18, in the direction orthogonal to the axial lines each other. A drive shaft mechanism serving as a power transmission means using the vertical shaft 26 for transmitting a full turn motion from the arm shaft 1 to the drive force transmission shaft 18 is thus constructed.

With such a construction, a full turn motion of the arm shaft 1 is transmitted through the gear 25 and the gear 27 to the vertical shaft 26. Further, it is transmitted from the vertical shaft 26 through the gear 28 and the gear 29 to the drive force transmission shaft 18. The full turn motion of the drive force transmission shaft 18, as in the fourth embodiment, is transmitted from the eccentric shaft through the coupling rod 19 and the eccentric shaft to the swing shaft 20. By the swing shaft 20, it is transformed into a swing motion. The swing motion is transformed into a half turn motion through the gear 20*b* and the gear 21*a*. The half turn motion is transmitted to the oscillating shaft 21 with the shuttle section 22.

The half turn transmission system for transmitting a half turn motion to the oscillating shaft 21 according to the sixth embodiment has the useful effects comparable with those of the fifth embodiment.

While in the above-mentioned embodiments of the present invention, a rotation is taken out of the arm shaft, it may be taken out of any other rotary shaft in which the arm shaft is fully turned. In the embodiments, the timing belt mechanism or the drive shaft mechanism is used for the full turn transmission means. Another power transmission mechanism may be used for the full turn transmission means, as a matter of course. It is to be understood that the invention is not limited in its application to the details of construction and arrangement of parts illustrated in the drawings.

A drive force transmission for a shuttle section in a sewing machine according to the present invention includes a drive force transmission shaft to which a rotation is transmitted from an arm shaft through a power transmission means, and a force transforming means between the drive force transmission shaft and an output shaft with a shuttle section. With this construction, the full turn is transmitted up to the drive force transmission shaft near the output shaft, thereby reducing a mass of the half turn transmission mechanism necessary for driving the shuttle section. This results in lessening a load of the gear caused by an inertia thereof generated by the half turn, a twist of the drive force transmission shaft, noise by a tooth sound, and vibration.

In the present invention, a rotation is taken out of the arm shaft to the drive force transmission shaft through the power transmission means. With this construction, a rotation can be taken out of any position on the arm shaft. No provision of a crank on the arm shaft is required for obtaining a half turn. Therefore, the drive force transmission shaft which receives the full turn may axially be moved relative to the output shaft of half turn. Therefore, a design freedom is increased.

Furthermore, the force transforming means is a crank mechanism including an eccentric shaft arranged on the drive force transmission shaft, an eccentric shaft, arranged on a swing shaft, which is coupled with the output shaft with gears intervening therebetween, and a coupling member for coupling these eccentric shafts. With this construction, a full turn of the drive force transmission shaft is transformed into a half turn of the output shaft.

Still further, the power transmission means is a timing belt mechanism or a shaft drive mechanism. With this construction, a full turn of the rotary shaft may be transmitted in the form of a full turn of the drive force transmission shaft.

What is claimed is:

1. A drive force transmission for a shuttle section in a sewing machine in which the rotation of a spindle is transmitted and transformed into a swing motion of, an output shaft, wherein a first end portion of the output shaft is coupled with the shuttle section, the drive force transmission comprising:

power transmission means coupled with the spindle to rotate the spindle;

a drive force transmission shaft coupled with said power transmission means, said drive force transmission shaft rotating according to the rotation of the spindle through said power transmission means; and force transforming means provided between an end of said drive force transmission shaft and a second end portion of the output shaft, for transforming the rotation from said drive force transmission shaft into the swing motion of the output shaft.

2. The drive force transmission according to claim 1, wherein said force transforming means comprises a crank mechanism including:

a first eccentric shaft arranged on said drive force transmission shaft;

a swing shaft coupled with the output shaft;

a second eccentric shaft arranged on said swing shaft; and a coupling member for coupling said first and second eccentric shafts.

3. The drive force transmission according to claim 2, wherein an offset amount of said first eccentric shaft from said drive force transmission shaft is smaller than that of said second eccentric shaft from said sewing shaft.

4. The drive force transmission according to claim 1, wherein said power transmission means comprises a timing belt mechanism.

5. The drive force transmission according to claim 4, wherein said timing belt mechanism includes a timing belt put on the spindle and on said drive force transmission shaft, said timing belt being twisted.

6. The drive force transmission according to claim 1, wherein said power transmission means comprises a shaft drive mechanism.

7. The drive force transmission according to claim 6, wherein said shaft drive mechanism include a vertical shaft rotatable perpendicularly to the spindle.

8. The drive force transmission according to claim 1, wherein said drive force transmission shaft is parallel with the output shaft.

9. The drive force transmission according to claim 1, wherein said drive force transmission shaft is longer than the output shaft.

* * * * *